US008511032B2

(12) United States Patent
Abdel-Rahman et al.

(10) Patent No.: US 8,511,032 B2
(45) Date of Patent: Aug. 20, 2013

(54) BUILDING STRUCTURE HAVING STUDS VERTICALLY MOVABLE WITH RESPECT TO A FLOOR STRUCTURE

(75) Inventors: Nabil Abdel-Rahman, Raleigh, NC (US); John C. Herrmann, Raleigh, NC (US); Thomas C. Boyd, Raleigh, NC (US)

(73) Assignee: The Steel Network, Inc., Durham, NC (US)

( * ) Notice: Subject to any disclaimer, the term of this patent is extended or adjusted under 35 U.S.C. 154(b) by 0 days.

(21) Appl. No.: 13/311,802

(22) Filed: Dec. 6, 2011

(65) Prior Publication Data

US 2013/0139466 A1 Jun. 6, 2013

(51) Int. Cl.
*E04H 12/00* (2006.01)

(52) U.S. Cl.
USPC ..... 52/655.1; 52/573.1; 52/713; 248/228.1; 248/228.6

(58) Field of Classification Search
USPC ..... 52/655.1, 688, 665, 713, 715, 283, 52/285.3, 289, 489.1, 573.1, 702; 248/300, 248/218.4, 228.1, 228.3, 228.6, 243, 244, 248/220.1, 221.11, 250; 403/403, 231, 109.1, 403/109.2, 109.4, 205, 241
See application file for complete search history.

(56) References Cited

U.S. PATENT DOCUMENTS 4,121,391 A 10/1978 Schroeder
4,433,524 A 2/1984 Matson
4,570,400 A 2/1986 Slager et al.
5,004,199 A * 4/1991 Suk ..... 248/218.4
5,224,322 A * 7/1993 van den Toorn ..... 52/765
5,467,566 A 11/1995 Swartz et al.
5,640,823 A 6/1997 Bergeron et al.
5,664,392 A * 9/1997 Mucha ..... 52/715
5,720,571 A 2/1998 Frobosilo et al.
5,810,303 A * 9/1998 Bourassa et al. ..... 248/205.1
5,846,018 A * 12/1998 Frobosilo et al. ..... 403/403
5,876,006 A 3/1999 Sharp
5,906,080 A * 5/1999 diGirolamo et al. ..... 52/243.1
6,058,668 A 5/2000 Herren
6,213,679 B1 * 4/2001 Frobosilo et al. ..... 403/403
6,389,658 B1 * 5/2002 Pfaller et al. ..... 24/545
6,612,087 B2 9/2003 diGirolamo et al.
6,668,510 B2 12/2003 McManus
6,688,069 B2 2/2004 Zadeh
7,174,690 B2 2/2007 Zadeh
7,360,745 B2 * 4/2008 Nikayin et al. ..... 248/216.1
7,478,508 B2 * 1/2009 Peterson ..... 52/573.1

(Continued)

OTHER PUBLICATIONS

QuickClip vertical slide clip allows for vertical building movement and provides up to 3" of horizontal standoff, Dietrich Metalframing.com; http://www.dietrichindustries.com/products/pdf/clipexpress/ClipExp_36_37.pdf.

*Primary Examiner* — Joshua J Michener
*Assistant Examiner* — Babajide Demuren
(74) *Attorney, Agent, or Firm* — Coats & Bennett, P.L.L.C.

(57) ABSTRACT

A building structure is provided that includes a floor structure and a series of studs extending vertically adjacent the floor structure. A clip is provided. The clip is connected to the floor structure and projects outwardly therefrom and includes a stud retainer for engaging and retaining a flange of a stud. The stud retainer includes a channel through which the flange of the stud extends. The stud retainer is connected to the flange of the stud in such a manner that the stud can move vertically in the channel.

14 Claims, 7 Drawing Sheets

(56) References Cited

U.S. PATENT DOCUMENTS 8,262,043 B2 * 9/2012 Jafari ..... 248/231.81
2002/0062617 A1 * 5/2002 diGirolamo et al. ..... 52/688
2005/0127256 A1 * 6/2005 Johnson et al. ..... 248/205.1

* cited by examiner

BUILDING STRUCTURE HAVING STUDS VERTICALLY MOVABLE WITH RESPECT TO A FLOOR STRUCTURE

FIELD OF INVENTION

The present invention relates to building structures, and more particularly to a building structure comprising a floor structure and one or more studs where the one or more studs are retained with respect to the floor structure and wherein the floor structure is movable vertically with respect to the studs.

BACKGROUND OF THE INVENTION

In many building applications, it is desirable for the studs of the building to be generally retained closely adjacent a floor structure and wherein the floor structure is movable vertically with respect to the studs. There are systems being used today that connect studs to a concrete floor for example. The more popular systems include a bracket that connects to the edge of a concrete floor, for example, and projects therefrom to where an outer portion connects to the stud. The problem with these designs is that it is difficult to connect the bracket to both the concrete floor and the stud. In many cases, a worker stationed on a concrete floor has to lean over the edge of the concrete floor in order to make the connection. Furthermore, the connecting structures of the prior art are not designed to facilitate the worker being able to easily grasp the studs and position the studs adjacent the concrete floor for easy attachment.

Therefore, there is and continues to be a need for a connecting structure that enables a construction worker to easily connect the studs to a floor or floor support structure such that the studs are generally retained but yet have the ability to move vertically with respect to the floor or the floor support structure.

SUMMARY OF THE INVENTION

The present invention relates to a clip for connecting a stud to a floor structure such as a floor or a floor support. The clip includes a base that connects to the floor structure and stud retainer. The stud retainer in one embodiment includes a channel that receives a flange of a stud. Fasteners project through the channel and connect to the flange of the stud in a manner that retains the stud but yet allows the channel to move vertically along the stud.

Further the present invention entails a building structure comprising a floor and a series of metal studs extending adjacent the floor structure. A clip is provided for connecting each stud to the floor structure such that the clip is permitted to move vertically with respect to the stud and wherein the clip generally retains the stud adjacent the floor structure. The clip includes a base and a stud retainer. The stud retainer includes a channel. The stud includes a web and a pair of flanges and wherein one of the flanges of the stud is disposed within the channel of the stud retainer such that the flange of the stud is generally retained in the channel but wherein the flange of the stud is movable vertically in the channel. One or more fasteners extend through the channel and connect to the flange of the stud in a manner that enables the flange of the stud to move vertically in the channel.

Other objects and advantages of the present invention will become apparent and obvious from a study of the following description and the accompanying drawings which are merely illustrative of such invention.

DESCRIPTION OF EXEMPLARY EMBODIMENT

Figure 1:
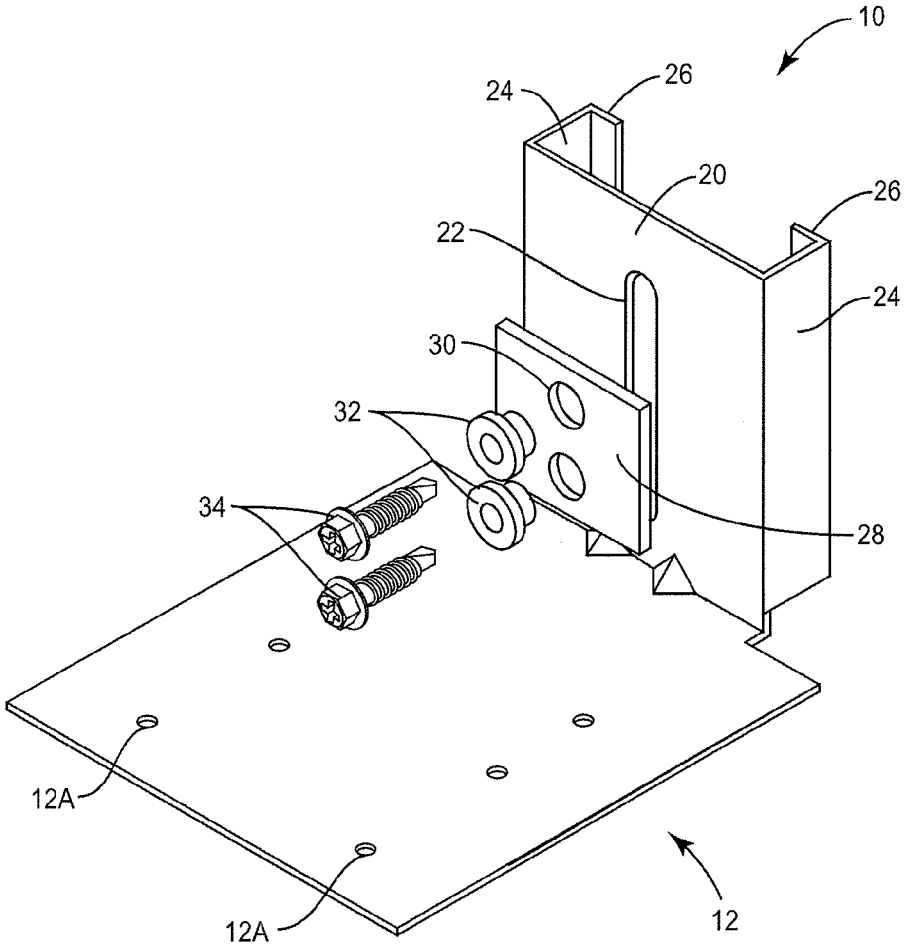
FIG. 1 is a perspective view of the clip of the present invention that is utilized to connect a stud to a floor structure.

With further reference to the drawings, a building structure is shown therein. The building structure includes a plurality of studs, each stud being indicated generally by the number 16 and a floor structure indicated generally by the numeral 18. The term "stud" means an elongated vertical member that forms a part of a wall and which is enclosed in the wall by wall boarding, drywall, etc. Studs 16 are retained adjacent the floor structure 18 by a series of clips, each clip being indicated generally by the number 10. As will become apparent from subject portions of the disclosure, the clips 10 are designed to generally retain the studs 16 closely adjacent the floor structure 18 but at the same time permit the floor structure to move vertically with respect to the studs.

Each stud 16 includes a pair of flanges 16A, a web 16B and a pair of returns 16C. Note that each return 16C extends inwardly from the terminal edge of a flange 16A.

Figure 5:
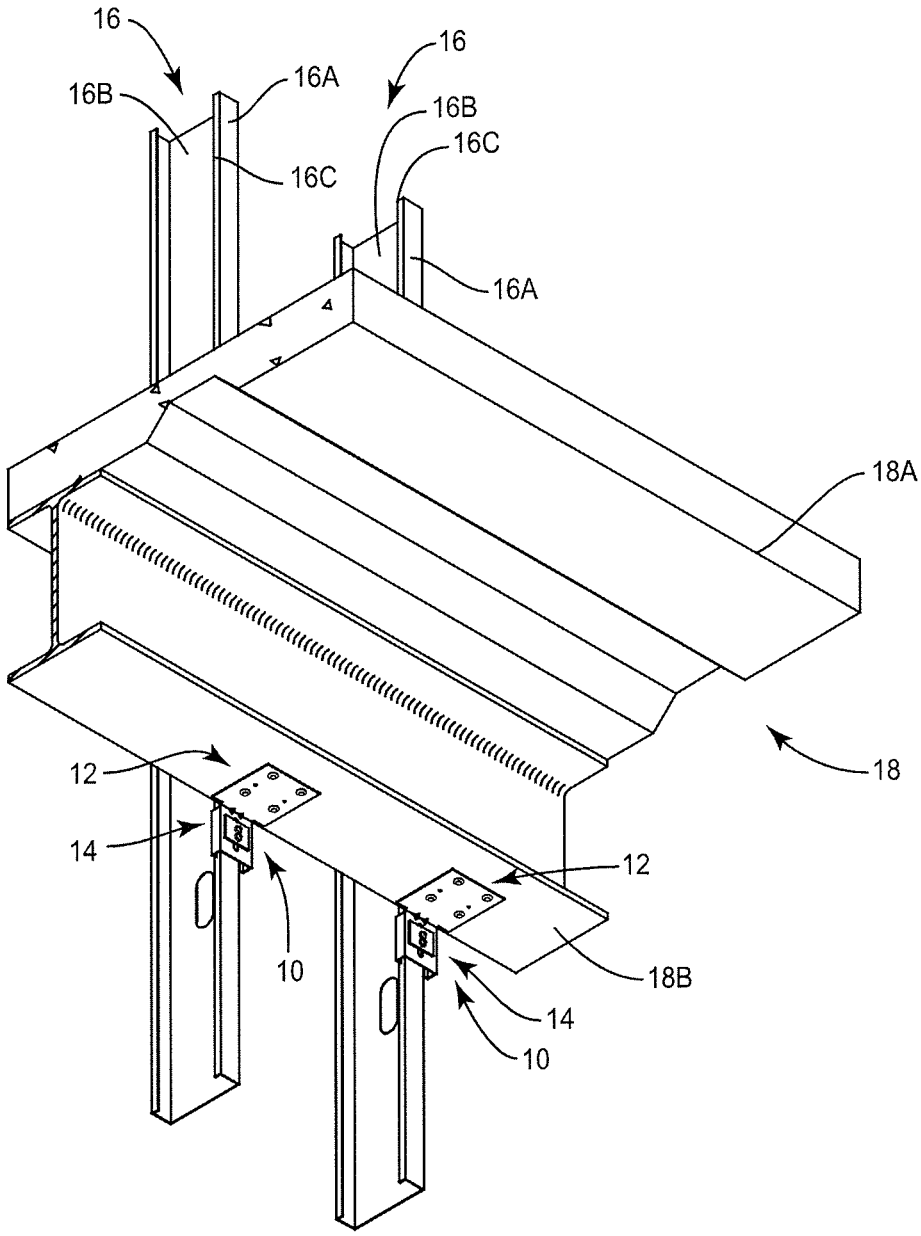
FIG. 5 is a perspective view showing the clips of the present invention interconnected between a floor support structure and a pair of studs.

The term floor structure as used herein, means a floor proper or a floor support structure. In the drawings the floor proper is referred to by 18A. See FIG. 3. Floor structure also means a floor support such as a beam or other support structure. A floor support or beam is indicated by 18B. See FIG. 5.

As seen in the drawings, each stud 16 is secured to the floor structure 18 by the clip 10. Viewing clip 10 in more detail, it is seen that the same includes a base member 12. In the particular embodiment illustrated herein, the base member 12 comprises a generally flat plate. The base member 12 includes a series of openings 12A. Openings 12A are designed to receive powder-activated fasteners 12B. Other types of fasteners can be utilized to secure the base member 12 to the floor structure 18. However, in one embodiment, the fasteners used are shot from a device and hence are called powder-activated fasteners.

Figure 2:
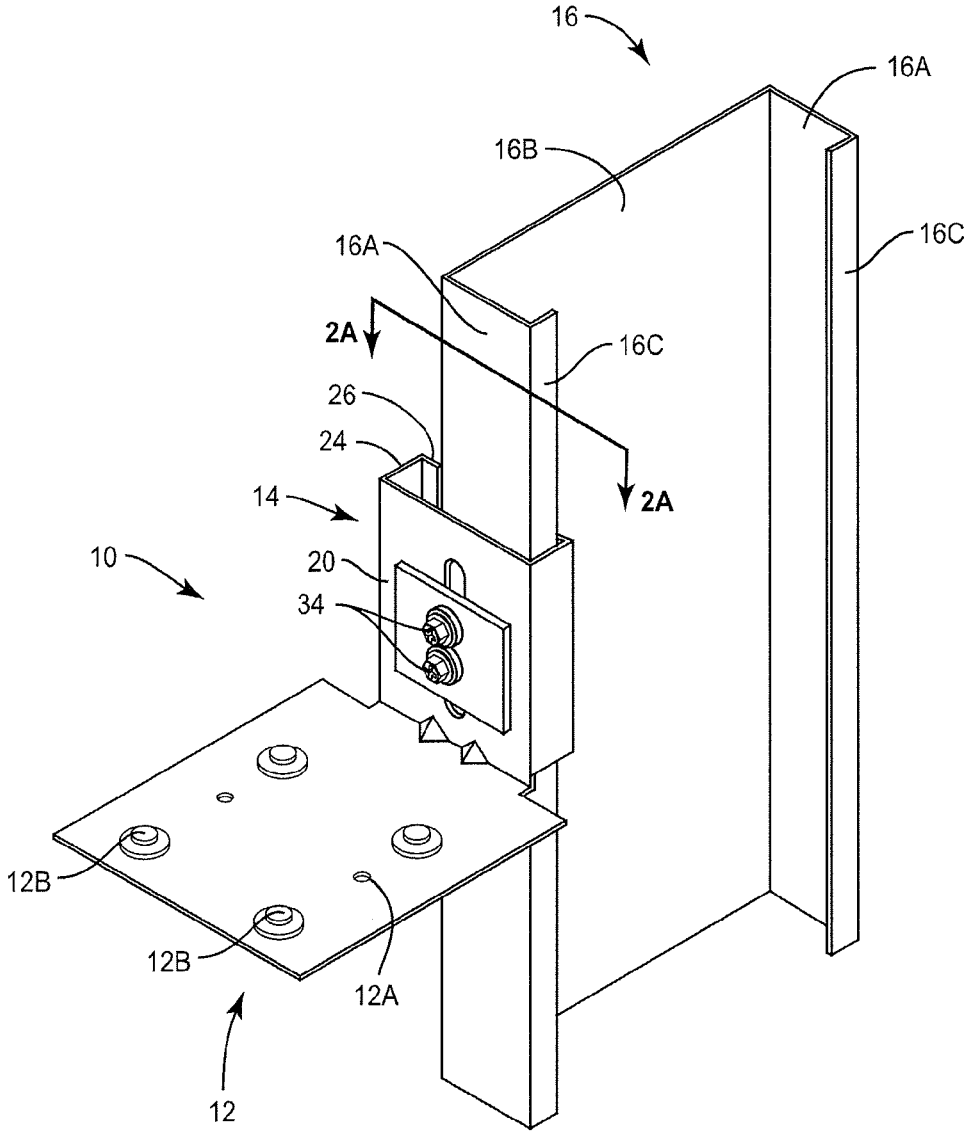
FIG. 2 is a perspective view showing the clip connected to the flange of a stud.
Figure 2A:
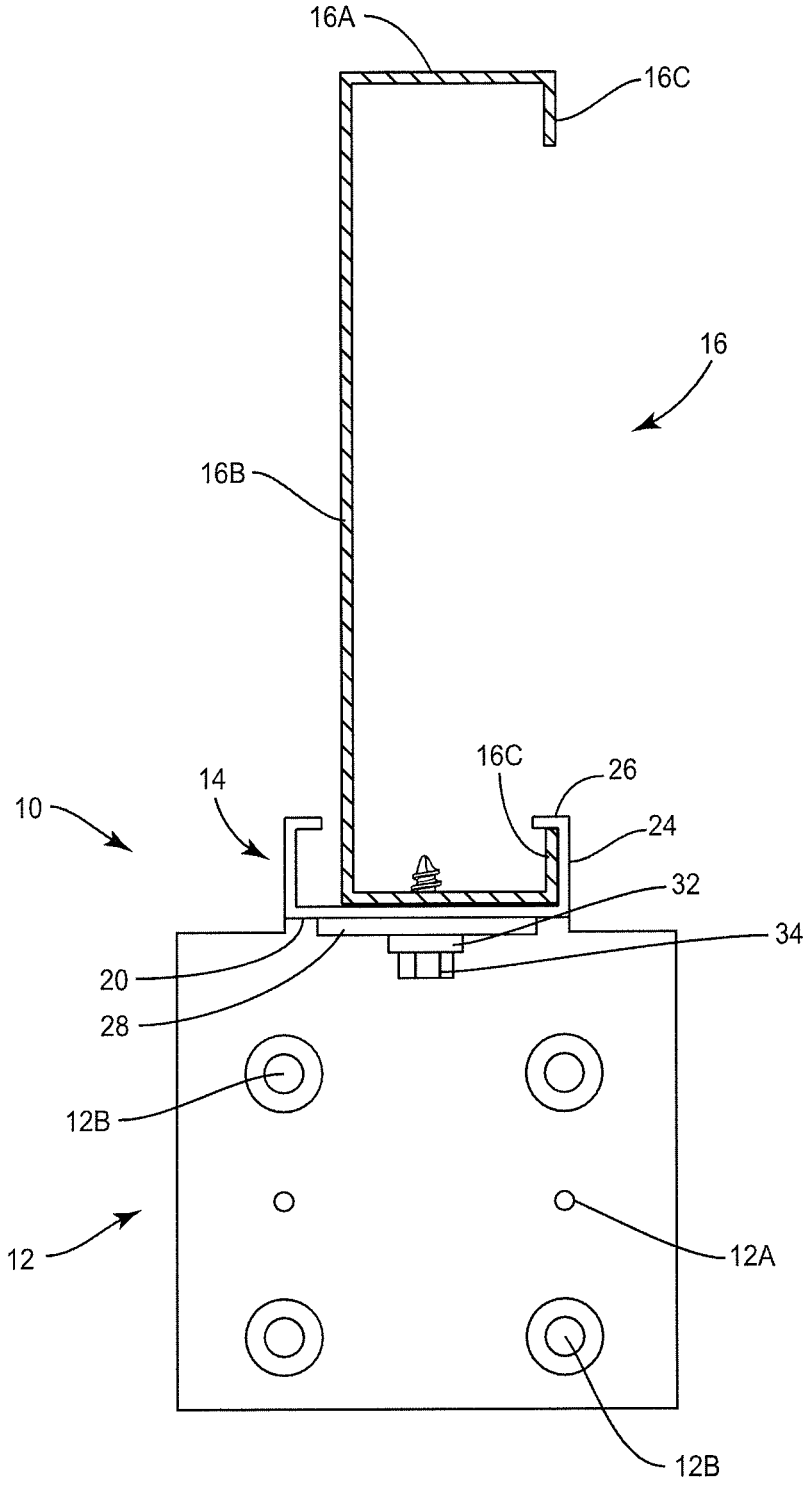
FIG. 2*a* is a fragmentary sectional view showing the flange of a stud confined within a stud retainer.

Projecting from the base member 12 is a stud retainer indicated generally by the number 14. As seen in FIG. 2, stud retainer 14 is designed to connect to one flange 16A of the stud 16. Again, there is a direct structural connection between the stud retainer 14 and the flange 16A of the stud 16. However, the connection is configured such that the stud retainer 14 can move vertically with respect to the stud 16.

Viewing the stud retainer 14 in more detail, it is seen that the same is formed into a structure that resembles a channel or at least a partial channel. The term channel as used herein, means a channel or even a partial channel such as the case with respect to the embodiment shown in FIG. 6. In any event, the channel structure of the stud retainer 14 comprises a web 20 and an elongated slot 22 formed in the web. The channel further includes one or two flanges 24. The embodiment shown in FIGS. 1 through 5 includes a pair of flanges 24 while the embodiment in FIG. 6 only includes one flange 24. In any event, a channel return 26 extends inwardly from the terminal edge of each flange 24.

Also forming a part of the stud retainer 14, in the case of one embodiment, is a reinforcing plate 28. Reinforcing plate 28 is disposed adjacent the exterior surface of the web 20. In the case of the embodiment shown, the reinforcement plate 28 includes a pair of openings 30. A pair of step bushings 32 extends through the openings 30 in the reinforcing plate 28. A fastener 34 extends through each step bushing 32 and hence through the elongated slot 22 in the web 20 and connects to the flange 16A of the stud 16. The step bushing 32 enables the reinforcing plate 28 along with the fasteners 34 to move vertically with the stud 16. In other words, the stud 16 can move vertically within the channel defined by the stud retainer 14.

Figure 6:
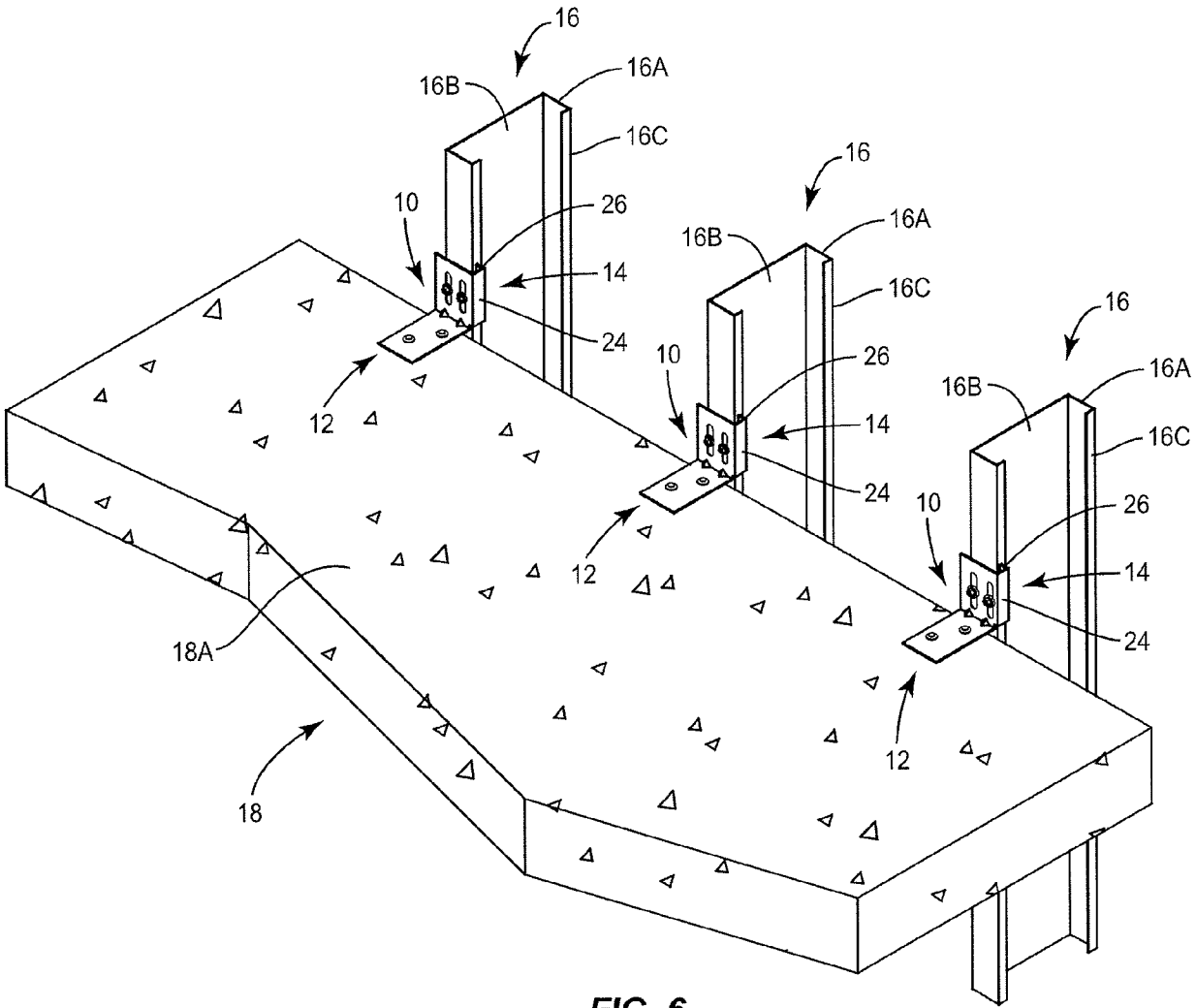
FIG. 6 is a perspective view similar to FIG. 3 but showing an alternative embodiment for the clips.

Note in FIG. 2 where the flange 16A is offset to one side of the channel. In that case, the return 26 of the stud retainer 14 wraps around the return 16C of the stud. Note that the return 26 disposed on the other side of the channel does not engage or effectively retain the flange 16A of the stud 16. As shown in FIG. 6, it follows that the channel of the stud retainer 14 does not have to include a pair of returns 26. One return 26 on one side of the stud retainer 14 is sufficient.

Also, in the case of the embodiment shown in FIG. 1, note that the distance between the terminal ends of the returns 26 of the channel is greater than the width of the flange 16A of the stud 16. This enables the flange 16A to be inserted into the channel and moved to one side before the fasteners 34 are screwed into the flange 16A.

Figure 3:
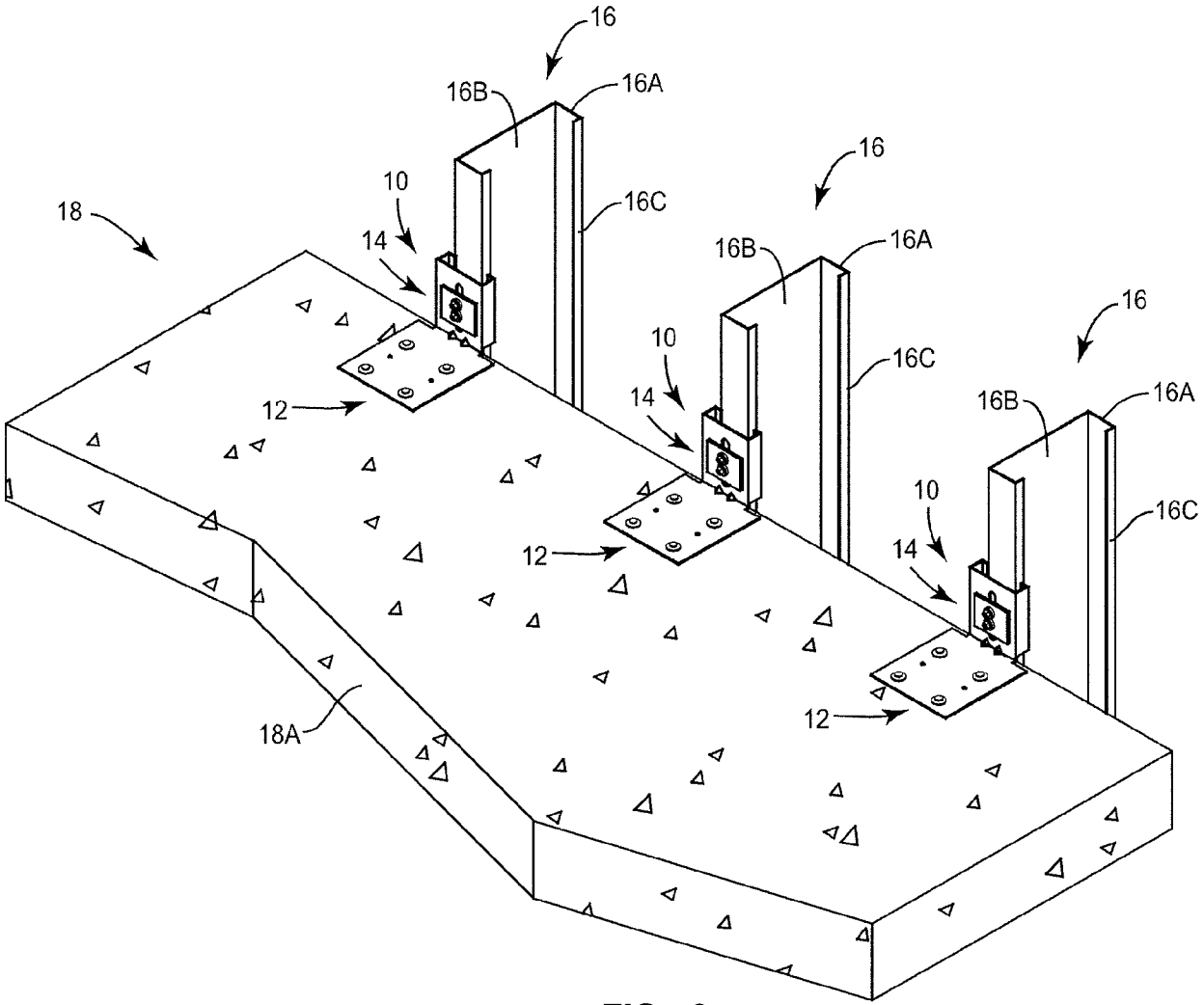
FIG. 3 is a fragmentary perspective view of a portion of the building structure showing three studs connected to a concrete floor.
Figure 4:
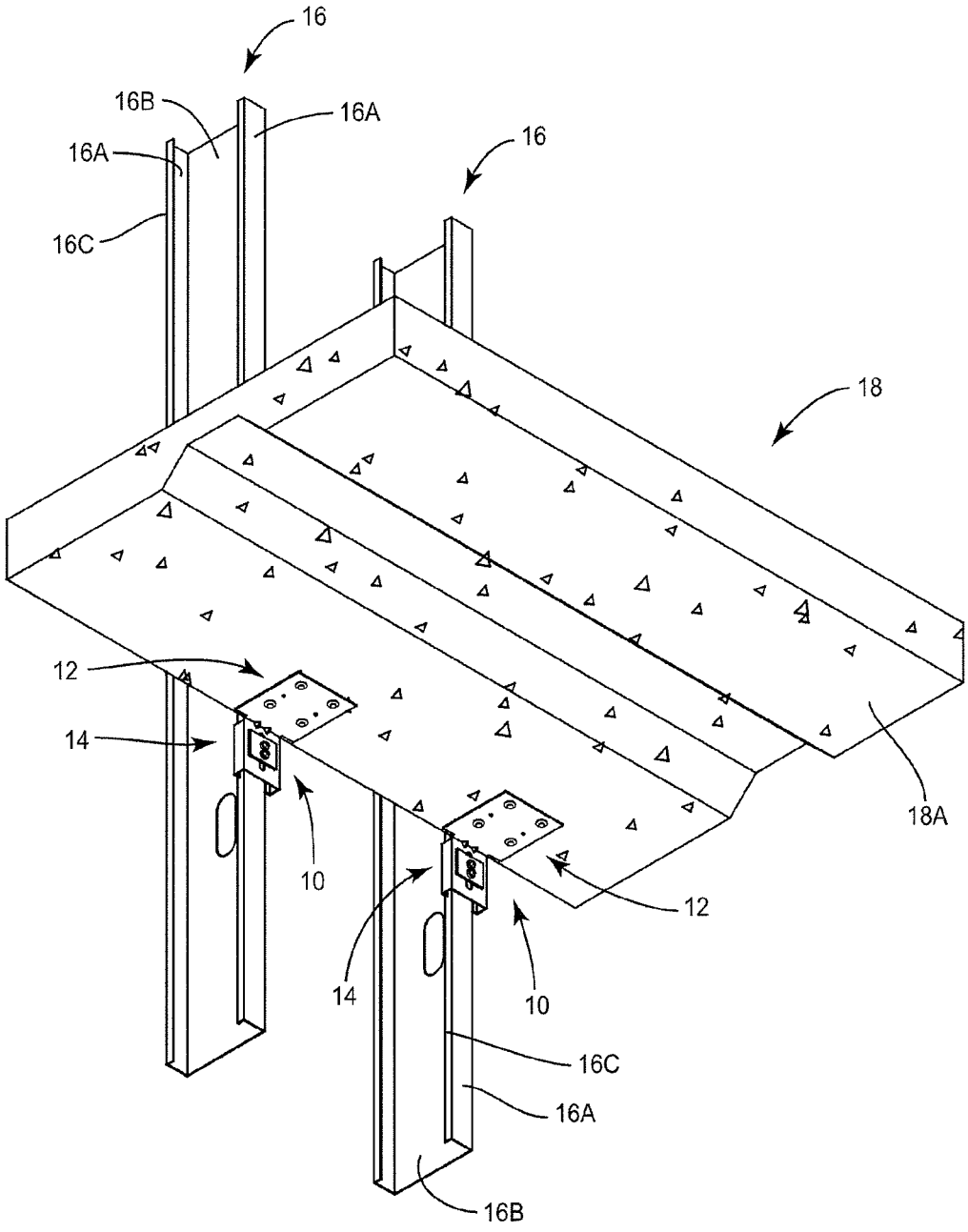
FIG. 4 is a perspective view similar to FIG. 3 but showing the clips connected to the underside of a concrete floor structure and projecting therefrom for connection to a pair of studs.

Note in the embodiment or design shown in FIG. 3, where the base members 12 are in the form of generally flat plates and are secured to the upper surface of a concrete slab 18A. Note that the stud retainer 14 forms a channel that surrounds a portion of the flange 16A. In the FIG. 4 design, the clips 10 are secured to the bottom edge of the floor 18A. Here again, the base member 12 is in the form of a plate that is secured to the bottom of the concrete floor. In the FIG. 5 embodiment or design, the clips 10 are secured to a floor support 18B which in this case is an I-beam. Note that the base members 12 are again in the form of a plate and are secured to the bottom surface of the I-beam.

Note the FIG. 6 embodiment where the channel formed by the stud retainer 14 is only a partial channel as the stud retainer 14 includes only one flange 24 and one return 26. Note also that the web 20 of the channel includes two elongated slots and in this embodiment there is no reinforcing plate 28. Again, the assembly includes a pair of step bushings extending through the pair of elongated slots and a fastener such as a screw extends through each step bushing and connects to the flange 16A.

Again, in all cases, the flange 16A of the stud 16 is connected to a screw or fastener 34, but yet the stud 16 is able to move vertically up and down with respect to the stud retainer 14.

There are many advantages to this design. It is simple and easy to manufacture. Also, this design enables the clips 10 to be secured to the stud 16 by a worker standing on the floor or on the floor structure indicated generally by the numeral 18. To attach the clips 10 to both the floor structure 18 and the studs 16 does not require the worker to lean over the edge of the floor structure 18.

The clip 10 can also be used to retrieve a stud 16 and position the stud adjacent the floor structure 18 for attachment. That is, the flange 24 and return 26 of the stud retainer can be utilized as a hook. A worker with the clip 10 in his or her hand can extend the clip outwardly and cause the flange 24 and return 26 of the stud retainer to engage and hook around the flange 16A and return 16C of the stud 16. Once engaged with the stud, the worker then pulls the clip 10 towards the floor structure where the stud can be properly positioned for attachment.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A building structure comprising:

a floor structure;

a metal stud extending adjacent the floor structure;

a clip for connecting the stud to the floor structure such that the clip is permitted to move vertically with respect to the stud but wherein the stud is generally retained adjacent the floor structure;

the clip including a base member for connecting to the floor structure;

the clip further including a stud retainer projecting from the base member and connected to the stud;

the stud retainer comprising a channel;

wherein the stud includes a web and a pair of flanges and wherein one flange of the stud is disposed within the channel of the stud retainer such that the flange of the stud is generally retained in the channel but wherein the flange of the stud is movable vertically in the channel; and one or more fasteners extending through the channel and connecting to the flange of the stud in a manner that enables the flange of the stud to move vertically in the channel.

2. The building structure of claim 1, wherein the stud further includes a return that projects from the flange retained by the stud retainer; and wherein the channel includes a web, at least one channel flange, and a channel return extending from the channel flange; and wherein the channel flange and the return channel extend around and retain the flange and return of the stud.

3. The building structure of claim 1, wherein the channel includes a web, a pair of channel flanges, and a channel return extending from each channel flange; and wherein the flange of the stud is confined within bounds defined by at least one channel flange and the channel return extending from the at least one channel flange.

4. The building structure of claim 1, wherein the channel includes an opening having an effective width greater than the effective width of the flange of the stud such that the flange of the stud can be inserted into the opening of the channel.

5. The building structure of claim 1, wherein the channel includes a web that includes an elongated slot; and wherein there is provided a reinforcing plate disposed adjacent an exterior surface of the web; the reinforcing plate having at least one opening formed therein; at least one step bushing extending through the opening in the reinforcing plate and through the elongated slot; and wherein the fastener extends through the step bushing, through the elongated slot and connects to the flange of the stud.

6. The building structure of claim 5, wherein the channel forms a hook that extends around multiple sides of the flange of the stud such that while the stud can move vertically within the channel, the formed hook limits the lateral side-to-side movement of the flange of the stud within the channel.

7. The building structure of claim 1, wherein the floor structure comprises a floor proper or a support structure for the floor.

8. The building structure of claim 1, wherein the channel of the stud retainer comprises a web, a pair of flanges and a pair of channel returns or the channel comprises a web and one channel flange and one channel return.

9. The building structure of claim 1 where the floor structure includes a floor or a floor support; and wherein the base member projects generally horizontally from the floor or floor support; and wherein the channel of the stud retainer projects vertically from the base member and is disposed at generally a 90° angle thereto.

10. The building structure of claim 9, wherein the base member comprises a generally flat plate secured flush against the floor or flush against the floor support and wherein the base lies in a plane that is generally perpendicular to the stud retainer.

11. The building structure of claim 9, wherein the channel includes a web that includes an elongated slot; and wherein there is provided a reinforcing plate disposed adjacent an exterior surface of the web; the reinforcing plate having at least one opening therein for receiving a step bushing; and wherein the step bushing extends through the opening in the reinforcing plate and through the elongated slot; and wherein the fastener extends through the step bushing and connects to the flange of the stud.

12. The building structure of claim 1, wherein there is provided one or more gussets or ribs formed in an area of the clip generally between the base member and the stud retainer.

13. The building structure of claim 1, wherein the channel includes a web, a pair of channel flanges and a channel return extending from each channel flange; and wherein the flange of the stud is disposed in an offset relationship within the channel such that one of the channel returns is positioned to retain the flange of the stud while the other channel return of the channel is not positioned to retain the flange of the stud.

14. The building structure of claim 1, wherein the channel includes a web, a pair of channel flanges and a channel return extending from a terminal end of each channel flange; and wherein the flange of the stud is inserted into the channel such that the flange of the stud extends through one side portion of the channel where one channel return extends around the flange of the stud while the other channel return of the channel does not extend around the flange of the stud.

* * * * *